US005253585A

United States Patent [19]

Hudak et al.

[11] Patent Number: 5,253,585

[45] Date of Patent: Oct. 19, 1993

[54] EXPLOSIVE PIPE CRIMPING METHOD AND DEVICES

[76] Inventors: David Hudak, 349 East 12th Street, North Vancouver, B.C., Canada, V7L 2K1; Andrew McQuilkin, 10384 McSween Rd., Chilliwack BC, Canada, V2P 6H5; Stephen B. Murray, 101 Primrose Drive S.E., Medicine Hat, Alberta, Canada, T1B 2C4; David V. Ritzel, 246 - 2nd Street S.W., Medicine Hat, Alberta, Canada, T1A 4A9

[21] Appl. No.: 874,105

[22] Filed: Apr. 27, 1992

[30] Foreign Application Priority Data

Apr. 26, 1991 [GB] United Kingdom ..... 9109097

[51] Int. Cl.[5] ..... F42B 3/00

[52] U.S. Cl. ..... 102/311; 102/309; 102/310; 102/312; 102/313; 299/13

[58] Field of Search ..... 102/309, 311, 312, 313, 102/310; 299/13

[56] References Cited

U.S. PATENT DOCUMENTS

| | | | |
|---|---|---|---|
| 3,099,216 | 7/1963 | Jakobsen et al. | 102/22 |
| 3,103,882 | 9/1963 | Gilliland | 102/24 |
| 4,018,163 | 4/1977 | Brown | 102/24 |
| 4,290,486 | 9/1981 | Regalbuto | 102/312 |
| 4,357,873 | 11/1982 | Jager | 102/310 |
| 4,440,447 | 4/1984 | Ricketts et al. | 102/312 X |
| 4,528,910 | 7/1985 | Blanc et al. | 102/306 |
| 4,815,385 | 3/1989 | Kingery et al. | 102/320 |
| 4,905,601 | 3/1990 | Gabriel et al. | 102/307 |
| 4,955,939 | 9/1990 | Petrousky et al. | 102/476 |
| 5,046,563 | 9/1991 | Engel et al. | 166/297 |

*Primary Examiner*—Peter A. Nelson
*Attorney, Agent, or Firm*—Terry M. Gernstein

[57] ABSTRACT

A main charge of explosive is positioned symmetrically about a passageway-forming tubular member, such as a well pipe assembly. The charge is outwardly and radially spaced from the member and is coupled thereto by a dense medium, such as soil, which is adapted to transfer the produced explosive energy to the tubular member in the form of a pressure pulse applied by the medium. Initiation charges are supplied at the outer surface of the main charge, to initiate a detonation wave directed at the tubular member. A layer of dense medium is provided to confine the non-coupled surface of the charge and retard venting of explosive gases away from the tubular member. In the end result, concentrated, converging pressure pulses are applied to the tubular member on detonation, to cause it to be symmetrically crimped to restrict the passageway.

5 Claims, 5 Drawing Sheets

EXPLOSIVE PIPE CRIMPING METHOD AND DEVICES

FIELD OF THE INVENTION

The present invention relates to an explosive method for crimping a generally tubular member, such as the pipe assembly of an oil or gas well, to thereby restrict or close the flow passageway extending through the assembly.

BACKGROUND OF THE INVENTION

The present invention was developed as a technique for controlling a wild oil or gas well, although it may find application in other applications where one wishes to quickly close a tubular assembly.

The invention was conceived with the notion of providing a one-shot explosive procedure which could be used on a wild well to crimp the pipe assembly to restrict the flow passageway through the assembly and thereby stop or reduce the hydrocarbon flow.

The invention incorporates some concepts taught in the prior art. More particularly, it is known to use shaped charges to cause directionally controlled explosive shock waves or jets, for example for cutting through a wall. It is also known to use an incompressible dense medium (water or sand) to confine detonation products on one side to promote jetting of the detonation products in a direction away from the confining material (see U.S. Pat. No. 4,905,601 as an example).

However, to the best of our knowledge there is no prior art teaching as to crimping or compressing a well stem with shaped charges or to a workable system for achieving that end. It is the objective of the present invention to provide such a system.

SUMMARY OF THE INVENTION

In accordance with the invention, a symmetric explosive main charge is positioned about the periphery of a flow passageway-forming, generally tubular assembly (the 'target'). The main charge is outwardly and radially spaced from the target. It may take the form of a concentric collar extending completely around the target or one or more pairs of opposed discrete charges of equal size. The main charge is disposed in a plane perpendicular to the longitudinal axis of the target. Its inner portion is directly coupled to the target by a dense material, such as soil or water. Stated otherwise, a dense medium extends between the charge and target. Initiation charges, equipped with detonating means, are associated with the main charge along its length at points remote from the target. For example, if the portion of the target to be crimped is below the charge, the initiation charges are positioned high and to the outside with respect to the main charge. The non-coupled surface of the main charge is confined by a backing layer of dense material, such as water.

As a result of this arrangement, when the initiation charges are detonated simultaneously, a detonation front is propagated in the main charge in the direction of the target. The coupling medium is compressed by the explosive products to produce a converging pressure pulse(s) which crimps the target along a longitudinally extending target portion thereof. If the main charge consists of two equal, oppositely positioned charges spaced equally from the target in a common plane, then two converging pressure pulses should compress the coupling medium from opposite sides with substantially equal effect to crimp the target. The coupling medium further acts to isolate the target from the high pressure/high temperature gases produced by the detonation, thereby protecting it from damage. In a third function, the coupling medium acts to attenuate the pressure pulse and create a pressure gradient along the coupled length of the target. Thus, in practice, the target may be severely crimped, split or even destroyed in that portion of it nearest to the main charge. But at some point along its coupled length the pressure pulse is sufficiently attenuated so that no crimping occurs. Between these two extremes, the pressure pulse will have the appropriate combination of magnitude and duration to crimp the target to a desired extent without splitting or destruction. The confining dense layer has inertia and functions to retard the detonation gases from venting to atmosphere. This increases the duration of the pressure pulse and results in a higher proportion of well distributed energy being transferred into the coupling medium.

Otherwise stated, the use of a coupling medium ensures the target will experience the necessary combination of pressure and duration for good crimping to occur This is so because the pressure pulse attenuates as it travels through the coupling medium.

The nature of the target assembly, the spacing of the main charge from the target and the quantity and quality of the explosive used will of course affect the extent of crimping achieved. Routine experimentation will establish what is needed in the way of spacing and explosive charge to satisfactorily crimp the particular target under consideration.

Broadly stated, in one aspect the invention comprises a method for symmetrically crimping a target portion of a generally tubular, passageway-forming assembly comprising:

(a) emplacing an explosive main charge symmetrically about the assembly in spaced relation therewith and in a plane perpendicular to the longitudinal axis of the assembly, the main charge having a plurality of initiation charges associated therewith along its length adjacent an outer surface of the main charge remote from the target portion, the main charge having a coupling surface, the initiation charges, main charge, coupling surface and target portion being generally linearly aligned;

(b) coupling the coupling surface of the main charge with the target portion by means of a dense coupling medium extending between them;

(c) confining the non-coupled surface of the main charge with a layer of dense medium for retarding venting of detonation gases;

(d) the spacing of the main charge from the assembly and the quantity and quality of the explosive being selected to ensure that, upon detonation, the produced pressure pulse will compress the coupling medium to crimp the assembly; and (e) detonating the initiation charges simultaneously to propagate a detonation front through each portion of the main charge toward the coupling surface so that a convergent pressure pulse is produced which compresses the coupling medium and effects symmetrical crimping of the target portion to thereby restrict the passageway.

The invention is characterized by a number of important advantages, namely:

By use of a symmetric, peripheral main charge, designed to provide substantially equal and opposite, converging pressure pulses, which are applied to the side surface of the tubular target at substantially the same elevation, one can achieve symmetric crimping;

By coupling the spaced apart charge and pipe assembly with a dense medium, the target portion is isolated from the destructive gases of the detonation and thus preserved from structural damage; and By confining the charge and strategically placing the initiation charges, a directionally controlled and concentrated pressure pulse is obtained.

In the particular case of a wild burning well, the application of the invention can provide three desirable results, namely:

crimping of the pipe assembly to reduce or stop the flow;

excavation of a flat-bottomed, annular crater about the pipe assembly, to provide ready access to the healthy stem; and extinguishment of the flame.

DESCRIPTION OF THE PREFERRED EMBODIMENT

The invention has been demonstrated in three distinct embodiments which were successfully tested on pipe assemblies. These embodiments were referred to as:

(1) the surface-laid charge, (2) the discrete mined charges, and (3) the contact charge.

The three embodiments differed in certain respects but shared the common features of:

directional control, coupling, and confinement.

The embodiments are exemplified by the following examples.

EXAMPLE I

Surface-Laid Charge

Figure 1:
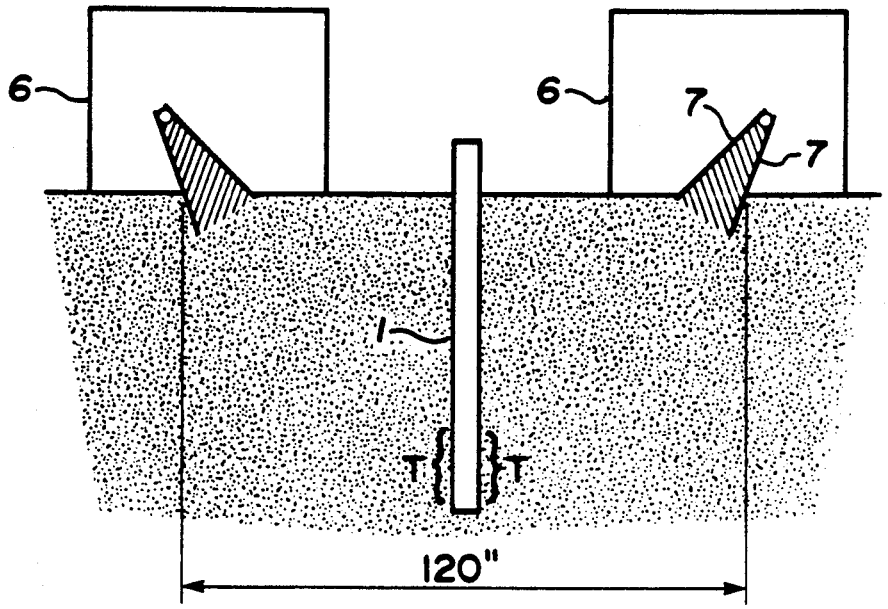
FIG. 1 is a schematic side view of the surface-laid system tested and described in Example I.
Figure 2A:
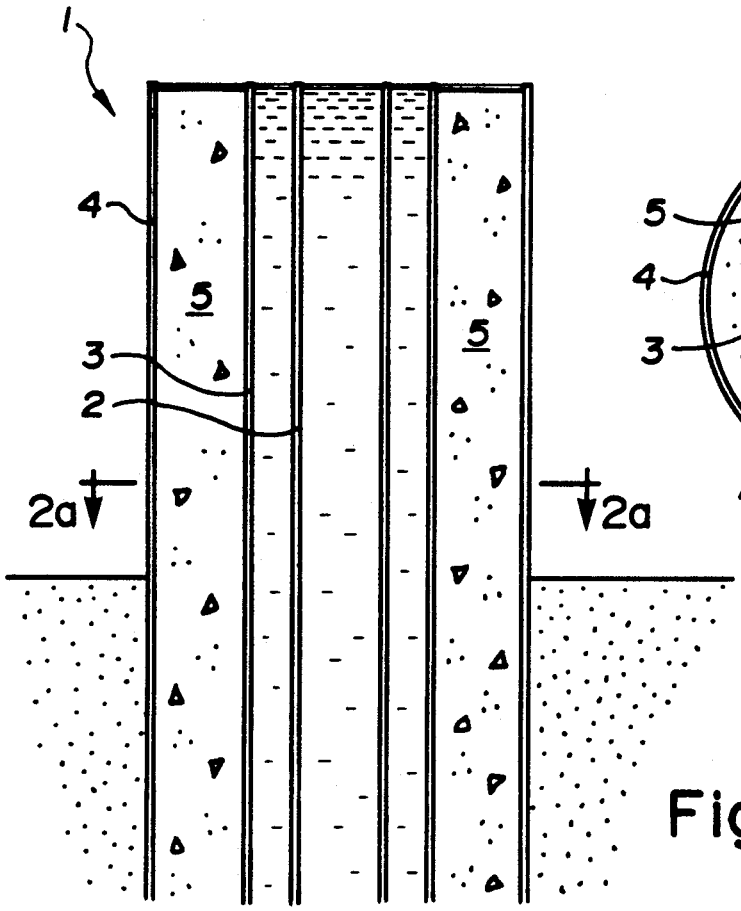
FIG. 2*a* is a sectional view of the pipe assembly of FIG. 1.
Figure 2:
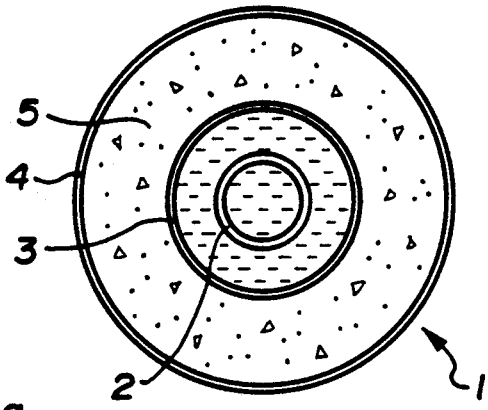
FIG. 2 is a side sectional view of the pipe assembly of FIG. 1.

A target pipe assembly 1 was constructed consisting of concentric 2-inch, 4-inch and 8-inch diameter Schedule 40 steel pipes 2, 3, 4 (FIGS. 1, 2). The pipes 2, 3, 4 were buried in the ground to a depth of about 8 feet. The annular space 5 between the two outer pipes 3, 4 was filled with class "G" oilwell cement. The pipes 2, 3, 4 extended above ground surface about 12 inches. The bore of the pipe 2 and the annular space between the pipes 2, 3 were filled with water.

Figure 3:
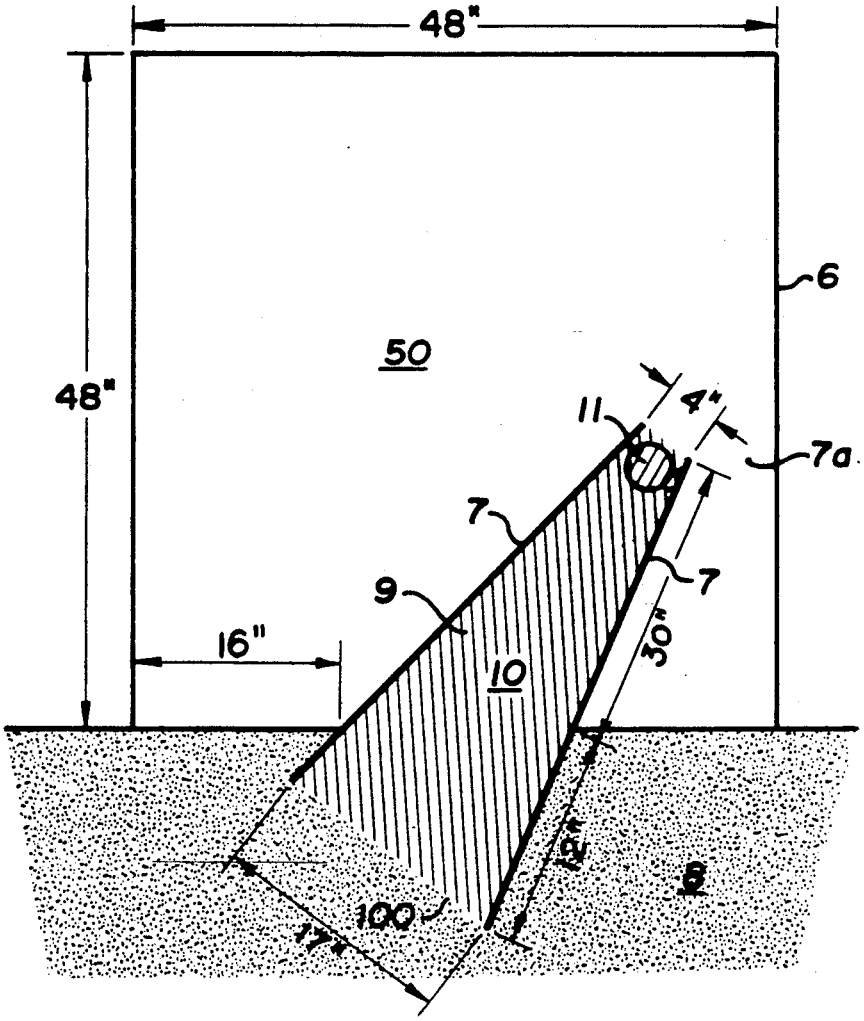
FIG. 3 is an expanded side view of the confining means, main charge, and part of the coupling means, showing dimensions of the test prototype of FIG. 1.

A pair of charge containers 6 were constructed of plywood. Each container 5 was a square cube (48 inches on a side) having an open bottom and top. A pair of baffles 7 were positioned in each cube 6 to extend between the side walls 7*a*. The baffles 7 were angled downwardly toward the well assembly target portion T, as shown in FIG. 3, and penetrated into the underlying soil 8 a short distance.

The soil 8 extended between the coupling surface or foot 100 of the charge 9 (which filled the baffle compartment 10) and the target portion T. The soil 8 functioned as a dense medium coupling the charge 9 with the target portion T to be crimped.

The cube 6 was lined with plastic sheeting and filled prior to detonation with water, to provide a confining layer 50.

The two containers 6 were located symmetrically on each side of the pipe assembly 1, so that the two charges 9 were parallel and equidistant from the vertical axis of the pipe assembly 1. The spacing between the containers 6 was 54 inches. This meant that the outer baffles 7 were 120 inches apart at ground level.

The wedge-shaped compartments 10 formed by the baffles 7 and cube walls 7*a* were each lined with plastic sheeting and filled with equal amounts of pumpable nitromethane explosive. Two waterproofed 1-pound pentaerythrite tetranitrate (PETN) explosive initiation charges 10 were placed, one adjacent each of the cube walls 7*a*, remote from the target portion T. Each initiation charge 10 was equipped with a 10-foot lead 11 of detonating cord (50 grains per foot). The free ends of the four detonating cord leads 11 were fastened to a single electric detonator (not shown).

Figure 4:
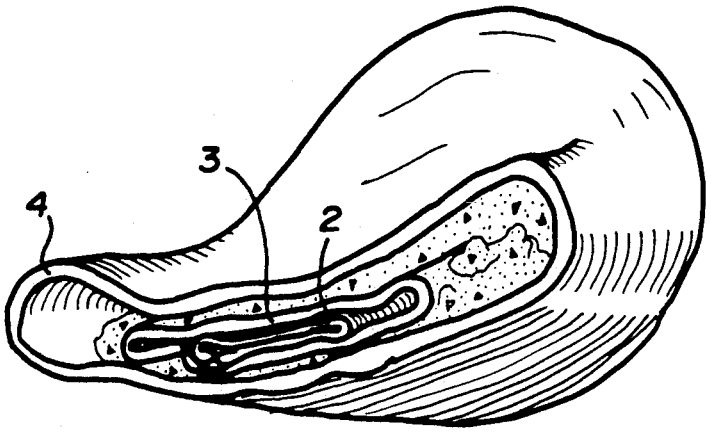
FIGS. 4 and 5 are perspective end views of the top end of the pipe assembly of Example I (surface-laid charge) after the detonation, showing the crimping which was achieved.
Figure 5:
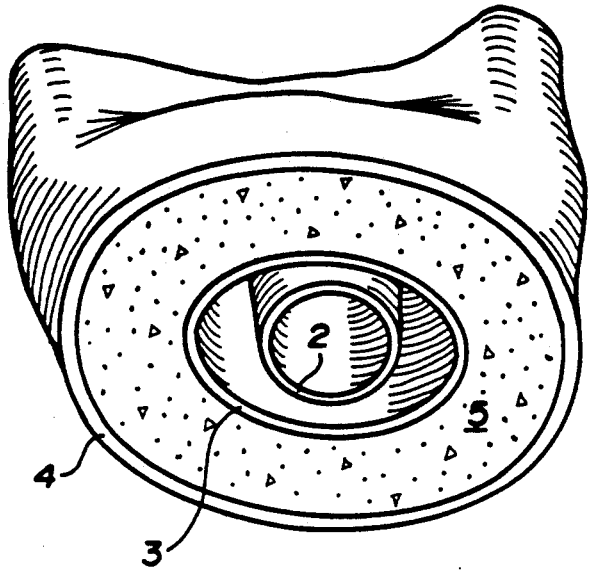
Figure 6:
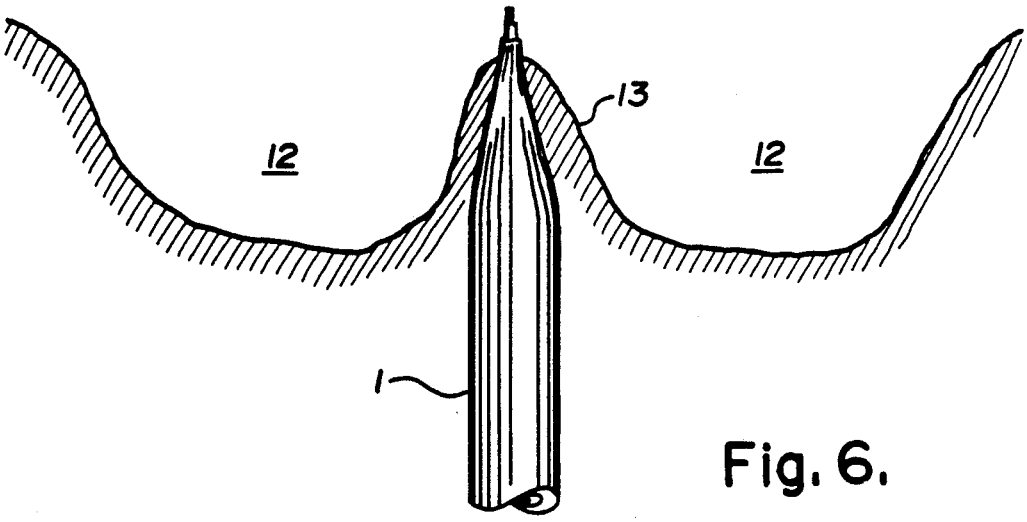
FIG. 6 is a side view showing a well assembly after crimping, with a crater having been formed and an isolation collar of soil protecting the healthy stem.
Figure 7:
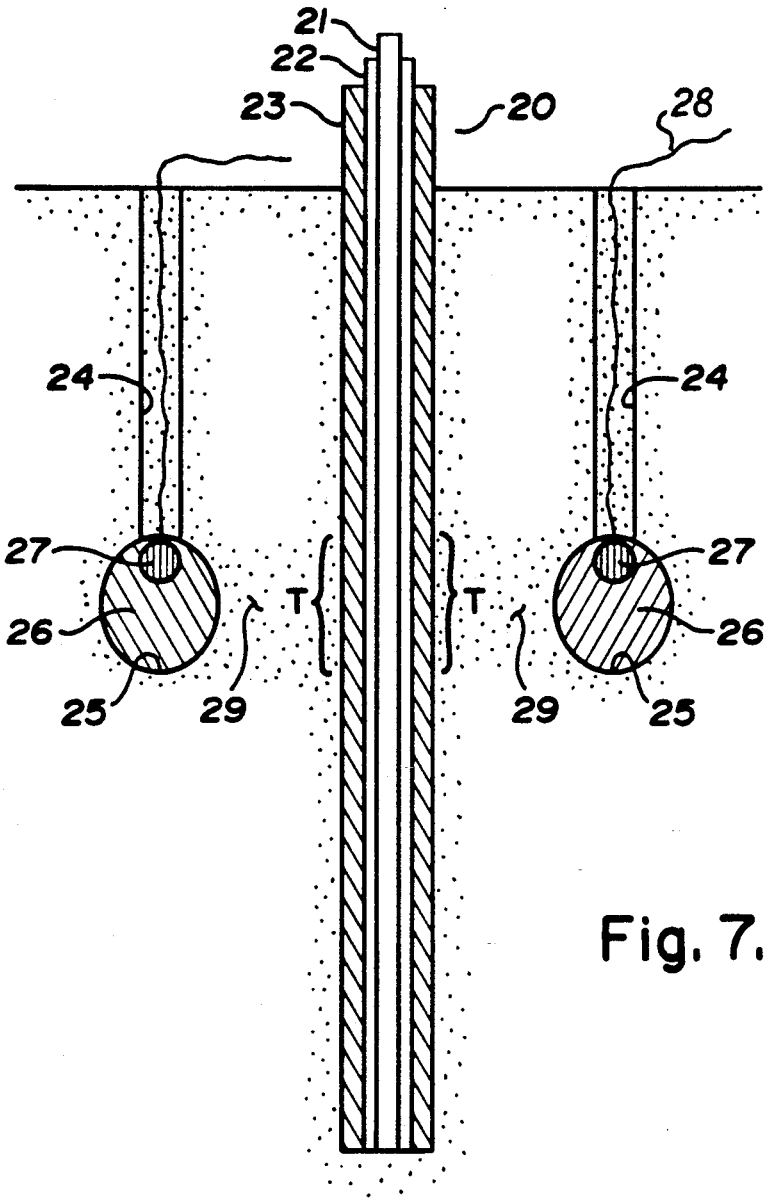
FIG. 7 is a schematic side view of the mined charge system tested and described in Example II.

The detonator was then actuated to detonate the explosive. The pipe assembly was crimped as shown in FIGS. 4 and 5. FIG. 6 shows the crimped well assembly 1, a flat-bottomed crater 12 formed by the detonation, and a soil collar 13 which remained in place during detonation and which functioned to protect the pipe stem within it from the hot detonation gases.

EXAMPLE II

Discrete Mined Charges

In this case, a pipe assembly 20 consisting of concentric 2-inch and 4-inch diameter Schedule 40 steel pipes 21, 22 was provided. The pipe assembly 20 was placed vertically into an 8-inch diameter augured hole 23 and cemented in place with Class G oilwell cement. The pipe assembly extended into the soil a distance of 8 feet. The bore of the pipe 21 and the annulus between the pipes 21, 22 were filled with water.

Two 4-inch diameter vertical holes 24 were augured in the soil 34 inches apart (center to center). The holes 24 were equidistant from the well assembly 20. Each hole 24 extended to a depth of 36 inches.

A 10-foot length of detonating cord (50 grain per foot) was attached to an explosive charge (0.4 pounds of PETN) of arbitrary shape. A charge of this nature was lowered to the base of each hole 24. The two detonating cords were fastened to a single electric detonator. The detonator was actuated to detonate the two charges simultaneously. This procedure resulted in the formation of generally spherical subterranean chambers 25 at the base of each hole 24.

Figure 8A:
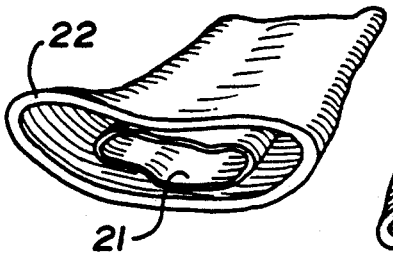
FIGS. 8*a*, 8*b* and 8*c* are perspective end views of three sections of the target area of the pipe assembly of FIG. 7 and Example II, showing a central section crimped flat and above and below sections to the left and right, crimped to a lesser extent.
Figure 8B:
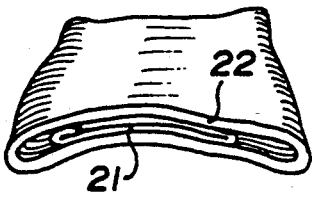
Figure 8C:
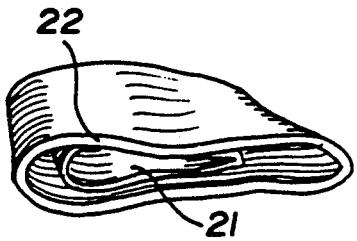

After the chambers 25 had cooled, 40 pounds of Trigram TM explosive 26 (pelletized and aluminized TNT), available from Canadian Arsenals Ltd. of Montreal, were poured into each chamber 25. A 0.5-pound PETN initiation charge 27 attached to the end of a 10-foot length of detonating cord (50 grain per foot) was lowered into each chamber 25. The holes 24 were then backfilled with soil. The two detonating cords 28 were connected with a single detonator (not shown). The detonator was actuated to detonate the charges simultaneously. The high pressure products of detonation expanded in the subterranean chambers, compressing the coupling soil 29 and crimping the pipe assembly 20. FIG. 8 shows the crimped target portion in top, central and lower sections, from left to right in FIG. 8.

EXAMPLE III

The Cylindrical Contact charge

In this case, a pipe assembly 30 consisting of concentric 2-inch and 4-inch diameter Schedule 40 steel pipes 31, 32 was placed vertically into a 4-inch diameter hole 33 augured into the ground. The hole 33 was about 5-feet in depth. The pipe assembly 30 extended about 1 foot above ground surface. Both pipes were filled with water.

A cylindrical container 34 having a centrally apertured plywood base 35 and an 18-inch diameter waxed cardboard sidewall 36 was placed over the pipe assembly 30. A thin plastic tube 37 of 12-inch diameter and 9-inch height was positioned within container 34 and concentric to pipe assembly 30.

Figure 9:
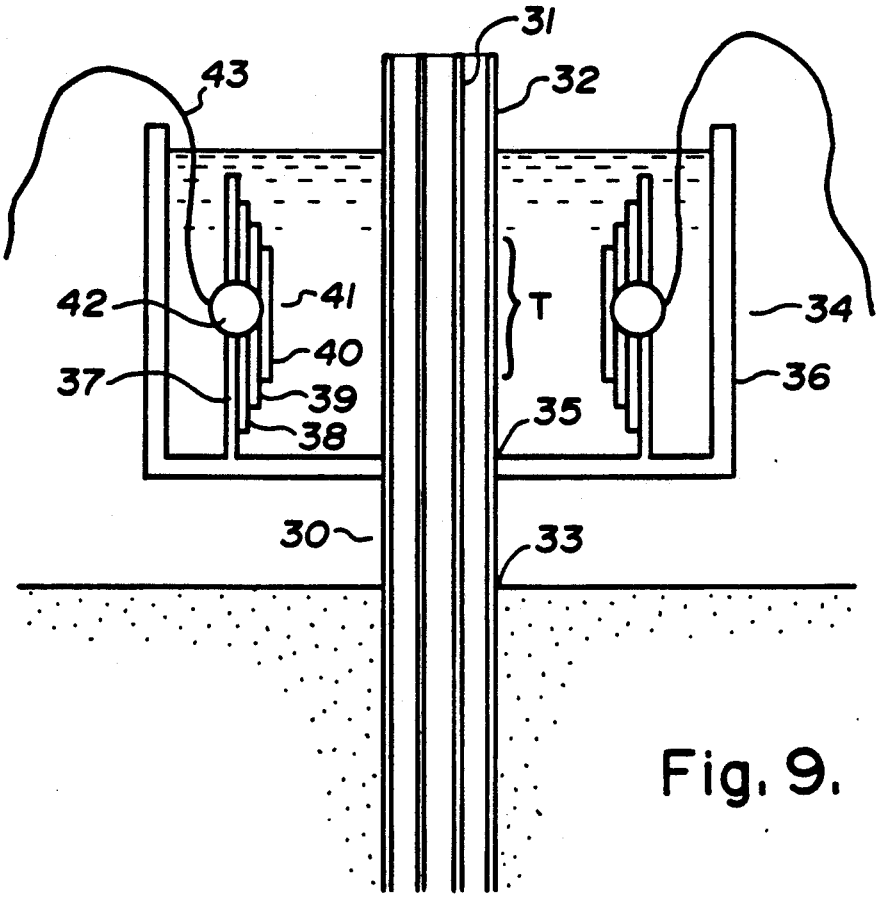
FIG. 9 is a schematic side view showing the cylindrical charge system tested and described in Example III.

Three wraps or sheets 38, 39, 40 of 0.25 inch thick sheet Datasheet TM explosive, consisting of 64% PETN, 7% nitrocellulose and 30% elastomeric binder, were glued to the tube 37 to form a stack 41. The sheets 38, 39, 40, had widths of 6-inches, 4-inches and 3-inches respectively. Each sheet formed a complete cylinder. The stack 41 provided a symmetric collar of 0.75-inches thickness. Diametrically opposed holes were formed in the back of the tube 37 and stack 41 assembly, to each accommodate a 10 gram primer charge 42. Detonating cords 43 connected the primer charges 42 with an electric detonator (not shown). The container 34 was then filled with water 44, as shown in FIG. 9, to provide a coupling and confining medium.

Figure 10:
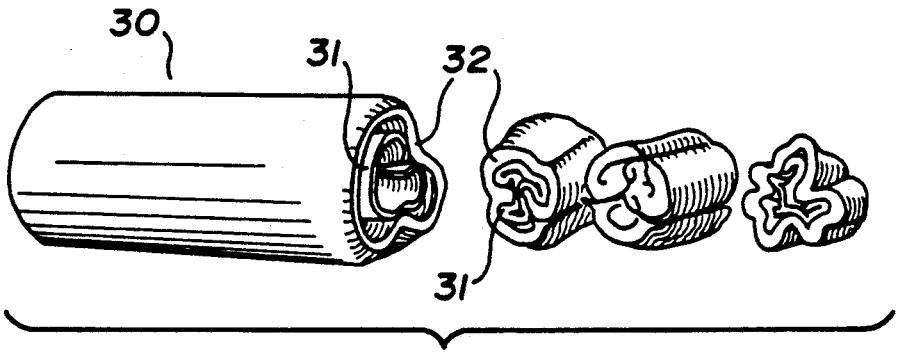
FIG. 10 is a perspective top view showing the crimped target portion of Example III, shown in sections.

The detonator was actuated to detonate the charges simultaneously. The crimped pipe assembly 30 is illustrated in FIG. 10.

The embodiments of the invention in which an exclusive property or privilege is claimed are as follows:

1. An explosive method for symmetrically crimping a target portion of a generally tubular, passageway-forming assembly, comprising:

emplacing an explosive main charge symmetrically about the assembly in spaced relation therewith and in a plane perpendicular to the longitudinal axis of the assembly, the main charge having a plurality of initiation charges associated therewith at an outer surface of the main charge remote from the target portion, said initiation charges being associated with means for detonation thereof, the initiation charges, main charge, and target portion being generally linearly aligned;

coupling the main charge with the target portion by means of a dense coupling medium extending between them;

confining the non-coupled surface of the main charge with a layer of dense medium for retarding venting of detonation gases;

the spacing of the main charge from the assembly and the quantity and quality of the explosive being adapted to ensure that, upon detonation, the produced pressure pulse will compress the coupling medium to crimp the assembly; and detonating the initiation charges simultaneously to propagate a detonation front through each portion of the main charge so that a convergent pressure pulse compresses the coupling medium and effects symmetrical crimping of the target portion to thereby restrict the passageway.

2. The method as set forth in claim 1 wherein:

the assembly is the pipe assembly of a well extending upwardly from the ground;

the main charge is laid on the ground and the coupling medium is soil surrounding the pipe assembly; and the initiation charges, main charge and target portion are generally linearly aligned along a downwardly inclined imaginary line.

3. The method as set forth in claim 1 wherein:

the assembly is the pipe assembly of a well extending upwardly from the ground; and the explosive main charge is emplaced by forming a plurality of downwardly extending holes of substantially equal depth in symmetric, outwardly spaced arrangement around the well assembly, inserting a small explosive charge in the base of each hole and detonating it to create a generally spherical subterranean chamber, substantially filling each chamber with an explosive charge, and inserting an initiation charge into each chamber.

4. An assembly for explosively and symmetrically crimping a target portion of a pipe assembly, comprising:

an explosive main charge positioned symmetrically about the pipe assembly in spaced relation therewith in a plane perpendicular to the longitudinal axis of the pipe assembly;

means for initiating detonation of the main charge, said means being associated with the main charge along its length and remote from the target portion whereby a detonation front directed toward the target portion may be initiated in the main charge;

a dense medium coupling the inner portion of the main charge with the target portion; and a layer of dense medium confining the non-coupled portion of the main charge, for retarding venting of explosion gases to atmosphere;

the spacing of the main charge from the pipe assembly and the quantity and quality of explosive being adapted to ensure that, upon detonation, the produced pressure pulse will compress the coupling medium to crimp the pipe assembly.

5. The assembly as set forth in claim 4 wherein:

the confining medium is selected from the group consisting of water or soil, and the coupling medium is selected from the group consisting of water or soil.

* * * * *